US005318288A

United States Patent [19]

Byttebier et al.

[11] Patent Number: 5,318,288

[45] Date of Patent: Jun. 7, 1994

[54] METHOD AND APPARATUS FOR PROCESSING SHEETS

[76] Inventors: Gaspar A. Byttebier, Grote Heerweg 64, Waregem - Beveren, Belgium, B-8749; Hendrik Lefebvre, Vlamingenstraat 42, Harelbeke, Belgium, B- 8530

[21] Appl. No.: 842,401

[22] PCT Filed: Jul. 27, 1990

[86] PCT No.: PCT/BE91/00052

§ 371 Date: Mar. 19, 1992

§ 102(e) Date: Mar. 19, 1992

[87] PCT Pub. No.: WO91/04214

PCT Pub. Date:

[30] Foreign Application Priority Data

Sep. 21, 1989 [BE] Belgium ..... 8901016

[51] Int. Cl.[5] ..... B65H 29/66

[52] U.S. Cl. ..... 271/216

[58] Field of Search ..... 271/216, 163, 3.1; 242/59

[56] References Cited

U.S. PATENT DOCUMENTS 3,981,495 9/1976 Bijttebier ..... 271/18.3
4,348,018 9/1982 Bijttebier et al. ..... 271/10
4,437,655 3/1984 Bijttebiere et al. ..... 271/3.1
4,528,798 7/1985 Meier ..... 242/59 X
4,572,499 2/1986 Bijttebier et al. ..... 271/251
4,676,496 6/1987 Honegger ..... 271/216 X
4,697,400 10/1987 Gerber ..... 242/59 X
4,903,908 2/1990 Hansch ..... 242/59

FOREIGN PATENT DOCUMENTS 2117359 10/1983 Japan ..... 271/3.1

*Primary Examiner*—David H. Bollinger
*Attorney, Agent, or Firm*—Cushman, Darby & Cushman

[57] ABSTRACT

The invention relates to a method, apparatus and equipment for processing supple sheets comprising feeding a series of successive sheets (4) to a processing unit (23) by releasing them from the successive winding of a belt roll (3) and conveying them to the inlet side of said unit where they are processed and for collecting them at the outlet of said unit. The collection is carried out by the successive clamping of the sheets between the successive windings of a belt roll (13). The roll so formed is directly usable at the inlet of a subsequent processing unit by submitting it to a suitable translation combined or not with either a rotation around an axis (33) parallel to the shaft (16) of the belt roll or around an axis perpendicular to said shaft.

14 Claims, 12 Drawing Sheets

FIG. 1
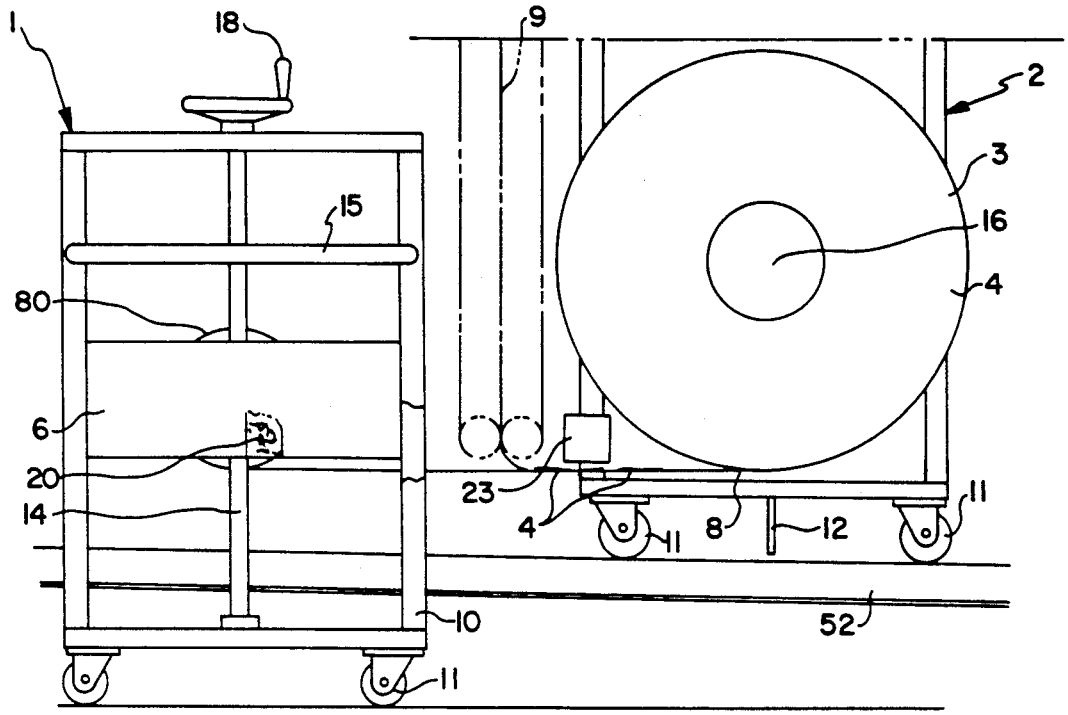
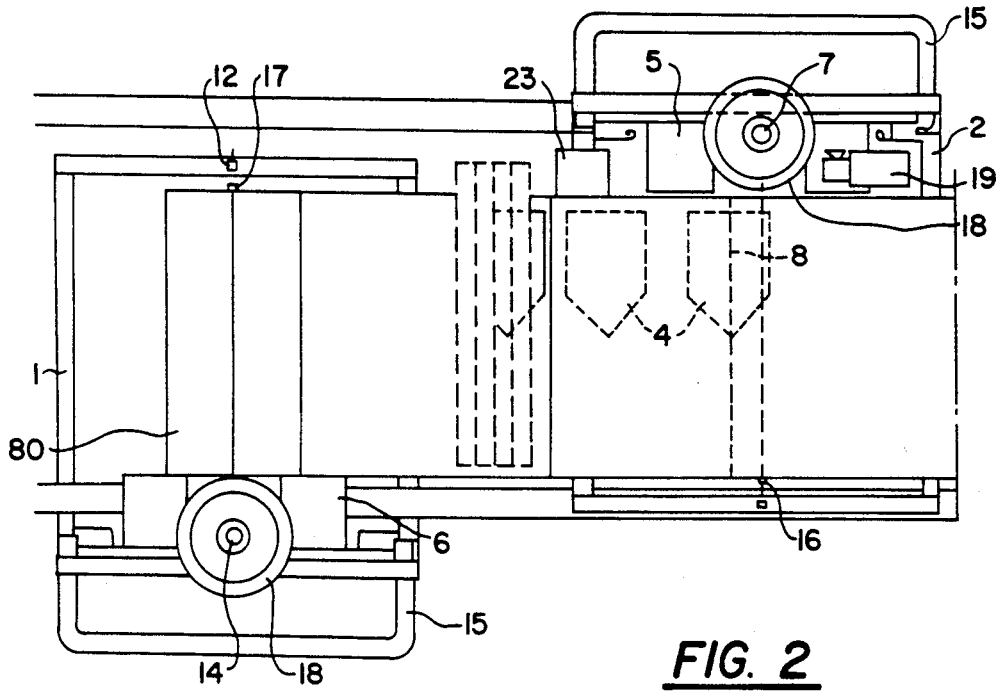
FIG. 2

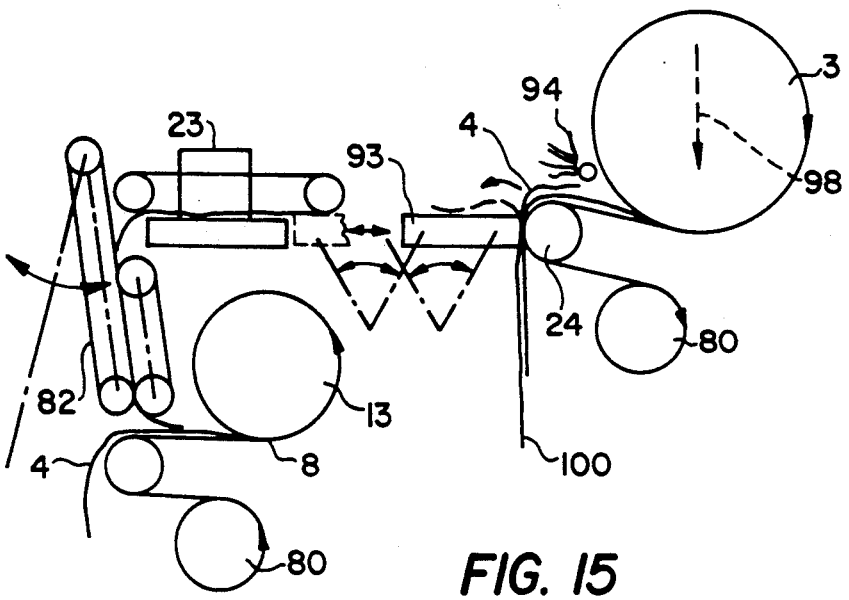
FIG. 15
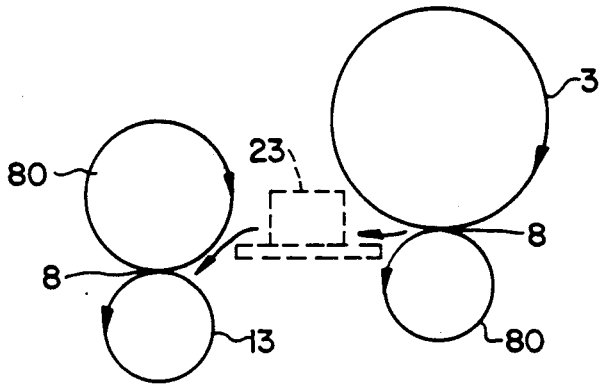
FIG. 16
FIG. 17
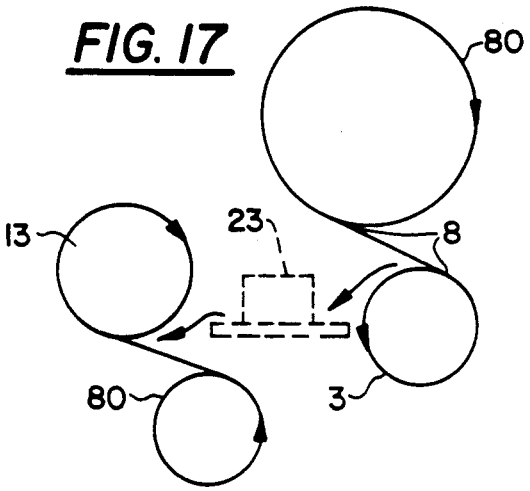

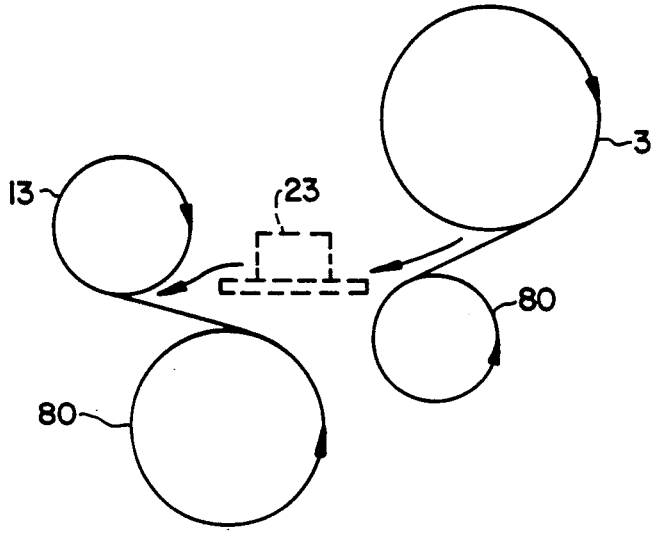
FIG. 18
FIG. 19
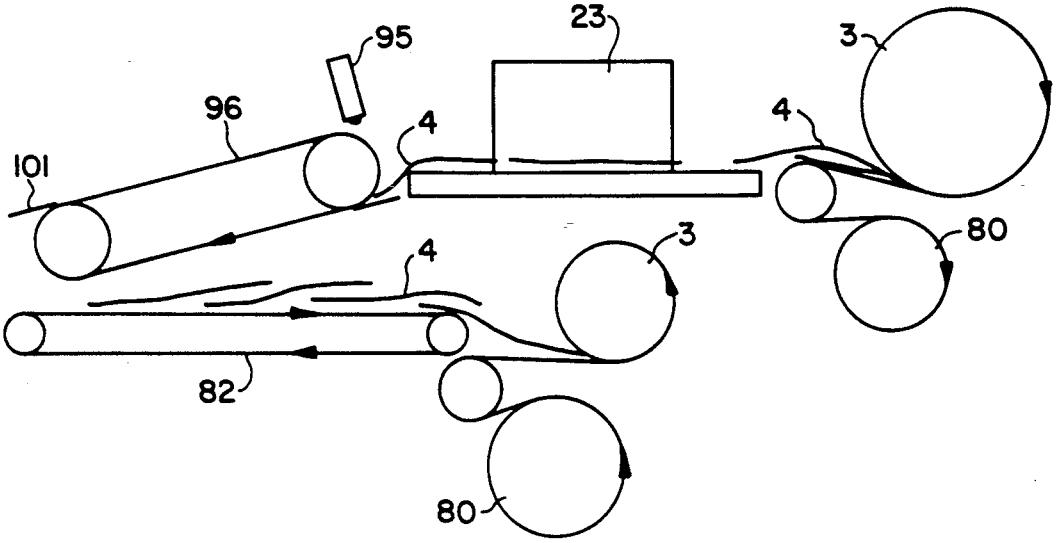

METHOD AND APPARATUS FOR PROCESSING SHEETS

The invention relates to a method and apparatus for processing sheets, particularly a series of successive textile sheets in a continuous or semi-continuous operation.

In clothing manufacture, it is often necessary to process series of successive sheets. Processing can comprise one or more operations such as hemming the sheets, positioning, joining, turning over or reversing, folding etc. It is an important requirement that these sheets arrive in the processing station in an appropriate predetermined position so as to be able to carry out the intended operation correctly. Numerous attempts have already been made to meet this. In particular, the present applicant has developed systems for removing sheets one by one from a stack and feeding these in an appropriate position to some processing unit. Generally, these sheet stacks come directly from the cutting shop of the clothing workshop.

Such systems are known for instance from U.S. Pat. Nos. 3,981,495, 4,348,018, 4,437,655 and 4,572,499 of the present applicant. Now, when these sheets leave this processing unit one by one to undergo a supplementary operation in a following station, they generally need to be collected or stacked again on way or the other. During this restacking operation, they then have to be collected or brought together again as precisely as possible in the desired position with a view to a smooth supply to this following processing station. Assuming that the processed sheets, delivered by a first processing unit, can be automatically stacked on top of each other in a smooth and precise way in a form analogous to that of original stacks that come from the cutting shop, a machine in accordance with U.S. Pat. No. 4,572,499 would be well suitable for a supply to a second (and following) processing station. This automatic precise stacking is a problem, however, so that the said machine is as yet less usable as automatic feeder of already partly processed sheets to a second or following processing unit.

It is in principle suggested in U.S. Pat. No. 3,729,959 to feed a textile washing installation at its inlet side with successive sheets from a belt roll between the windings of which the sheets are stored. During this unstacking, the sheets are released from the belt roll beyond a clamping line. After being processed in the washing machine the sheets are piled up one on top of the other in stacks.

It is now an object of the invention to provide i.a. a method, apparatus and equipment for processing a series of successive sheets that makes it possible to avoid a conventional stacking operation in piles of (completely overlapping) sheets laid on top of each other. In addition, it is an object of the invention to provide such a processing method and apparatus the construction of which is simple and, hence, not expensive and that is, nonetheless, readily adaptable to various processing needs. These objectives are met by providing a method comprising i.a. a stacking operation whereby a series of successive sheets are arranged one by one next to each other and are collected in this arrangement. Here, the terms "next to each other" mean completely separated from each other in each other's vicinity as well as partially overlapping. The arrangement and conveyance during the collection proper at the outlet of the processing unit is effected by the successive clamping of the sheets beyond a clamping line between the successive windings of a belt to be spirally wound from a stock as carrier and collecting element for the sheets. The belt is conducted with or without sheets along a predetermined route or path to a second storage place. The clamping or pinching line of the roll is here to be understood as referring to the place where the sheet is caught between two winding sections of the belt or released from there.

In summary the restacking of sheets into piles is avoided according to the invention by providing a method for processing supple sheets comprising feeding a series of successive sheets to a processing unit by releasing them from the successive windings of a belt roll as carrier for the sheets and conveying them to the inlet side of the unit for processing and for collecting them at the outlet of said unit by the successive clamping of the sheets in a predetermined orientation beyond a clamping line between the successive windings of a belt roll.

According to an important aspect of the invention the belt roll so formed is directly usable at the inlet side of a subsequent processing unit by submitting it to a suitable translation combined or not with either a rotation around an axis parallel to the axle or shaft of the belt roll or to an axis perpendicular to said axle. Said perpendicular axis can thereby be oriented either vertically or horizontally.

The belt winding devices, both at the inlet and outlet side of a processing unit are considered essential elements of the invention and will preferably be mutually interchangeable. This way they can be used both as feeder and as collector or restacker of any processing unit. In fact in clothing manufacture a number of manufacturing operations are performed one after the other (continuously or semi-continuously) on the same sheets. The sheets have then to be transported from one processing unit to the next one. The method, apparatus and equipment according to the invention enable now a very flexible transportation means throughout the entire processing chain, due to their interchangeable character.

The invention provides thus also for equipment suitable to apply the method described above. The equipment thus comprises in general a processing unit with means for feeding sheets to and for withdrawing them from said processing unit as well as mutually interchangeable apparatuses or devices as described below and wherein one of them is situated as a feeding device at the inlet side and the other as collecting device at the outlet side of the unit.

In the simplest embodiment, the route of the belt between its clamping lines with on the one side the first belt roll and on the other side the second belt roll, will run straight and nearly horizontally. The place of these clamping lines may or may not be kept stationary during the conveyance of the successive sheets.

In particular, the sheets can be put in a predetermined position on the belt during the passage through the predetermined route between belt roll and second storage element. The sheets can be reoriented and/or reversed at least once during their conveyance between the release and collection operation. This can for instance be effected by conducting the belt as carrier of the sheets through a positioning apparatus as described in U.S. Pat. No. 4,572,499 of the present applicant. In this case, the belt will preferably need to be provided with rows of small holes or perforations. In a preferred embodiment they can be arranged in a partially overlapping position just before collection or take up after processing. This way it is possible to maintain the total belt length on the belt rolls quite short and nevertheless to achieve a large sheet storage capacity between a rather small number of successive windings.

The stacking operation can also be linked with an operation whereby a number of sheets (for instance two, three or even more) are each time laid on top of each other into packets before these thus formed packets are processed further one by one, or restacked.

The invention also relates to an apparatus for carrying out the method just described. Basically, this apparatus comprises a supporting frame for rotatably supporting two belt rolls that can be wound and unwound and means to help determine the route of the belt section between said two belt rolls. According to the invention the supporting frame is adjustable in height, pivotable around an axis parallel to the axle or mandril or shaft of the belt rolls wherein the sheets are stored or collected and the supporting frame is mounted on a movable chassis. If so desired, the apparatus also comprises drive means for the belt.

The belt itself can at least one of its ends be provided with a mandril that extends at right angles to the longitudinal direction of the belt. This mandril then forms a strong extension for even winding and unwinding of the belt and possibly also for connection to the drive elements for winding. Preferably, the second storage element will also be a rotatably supported winding apparatus. As will be illustrated in detail hereinafter, this allows full application in two opposite directions of movement for the belt with sheets. The axes of rotation of the winding apparatus of first and second belt roll will then run parallel for most applications.

In some instances an apparatus should (in view of a flexible use) enable to perform both a rotation or revolving movement of the belt rolls around two axis perpendicular to the belt roll axle: one which is vertically oriented and one which is horizontally oriented. To meet this requirement the supporting frame for the belt rolls (which in itself enables a rotation around an axis parallel to the belt roll shafts) can be rotatably supported in a vertical ring, the position of which is vertically adjustably mounted on stands which are carried by a movable chassis. Due to the arrangement of this ring a revolving motion of the belt rolls becomes possible around said perpendicular horizontal axis.

From the viewpoint of flexibility, it is an important advantage if the various supporting means and guide means for the belt are mounted in their framework in such a way that they are adjustable. Likewise, it is advantageous to equip the apparatus so that it is wheeled or mobile.

The foregoing will now be illustrated on the basis of some possible embodiments and with reference to the drawings. Additional advantages will thereby become apparent. Insofar as elements or means are applied that are functionally the same or that operate in an equivalent way, they will generally be indicated with the same reference numerals in the figures for simplicity's sake.

It will be apparent from the further description of the drawings that in fact a number of principal embodiments are possible. In a first embodiment the belt rolls are placed at the same side of the belt section connecting said rolls between the respective clamping lines. Hence they rotate in the same direction (e.g. clockwise) during operation. The belt path between the point of release and point of collection can thereby run straight as shown in FIGS. 1 to 3.

In other instances specific guiding means (rollers or bar edges) are provided for helping to determine a non straight route for the belt. A distinction is then to be made of cases where those guiding means are placed at the same side of the belt as the belt rolls (e.g. as in FIGS. 6 and 7) and cases where they are placed at the opposite side as illustrated e.g. in FIGS. 8, 9 and 10. Alternatively guiding means can be present at either side of the belt section connecting the belt rolls.

Finally the two belt rolls can be arranged in a manner to rotate in opposite direction as shown e.g. in FIGS. 16 to 18 and 20, 21. In this case thus the two belt rolls are situated at a different side of the belt section connecting them. Again guiding means can be provided at one or both sides of the belt to determine a specific path to be followed by the belt between release and collection point.

FIG. 1 is a sketched elevation of an apparatus for stacking sheets which comprises two supporting frames for belt rolls and between which the belt runs.

FIG. 2 represents a top view of the apparatus in accordance with FIG. 1.

Figure 6:
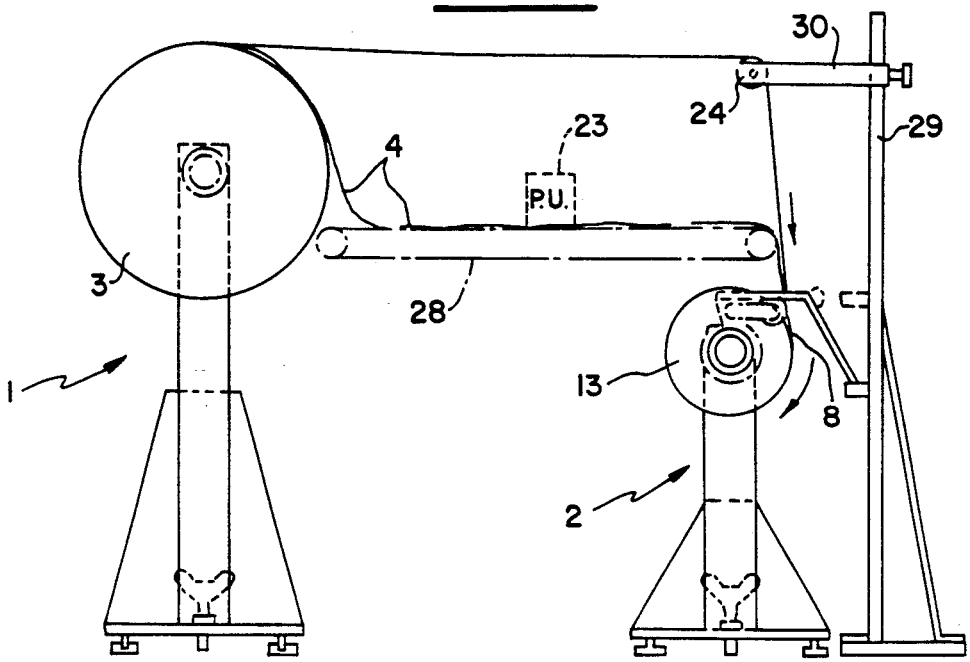

FIG. 6 relates to a variant setup of the apparatus with two distinct supporting frames.

Figure 7:
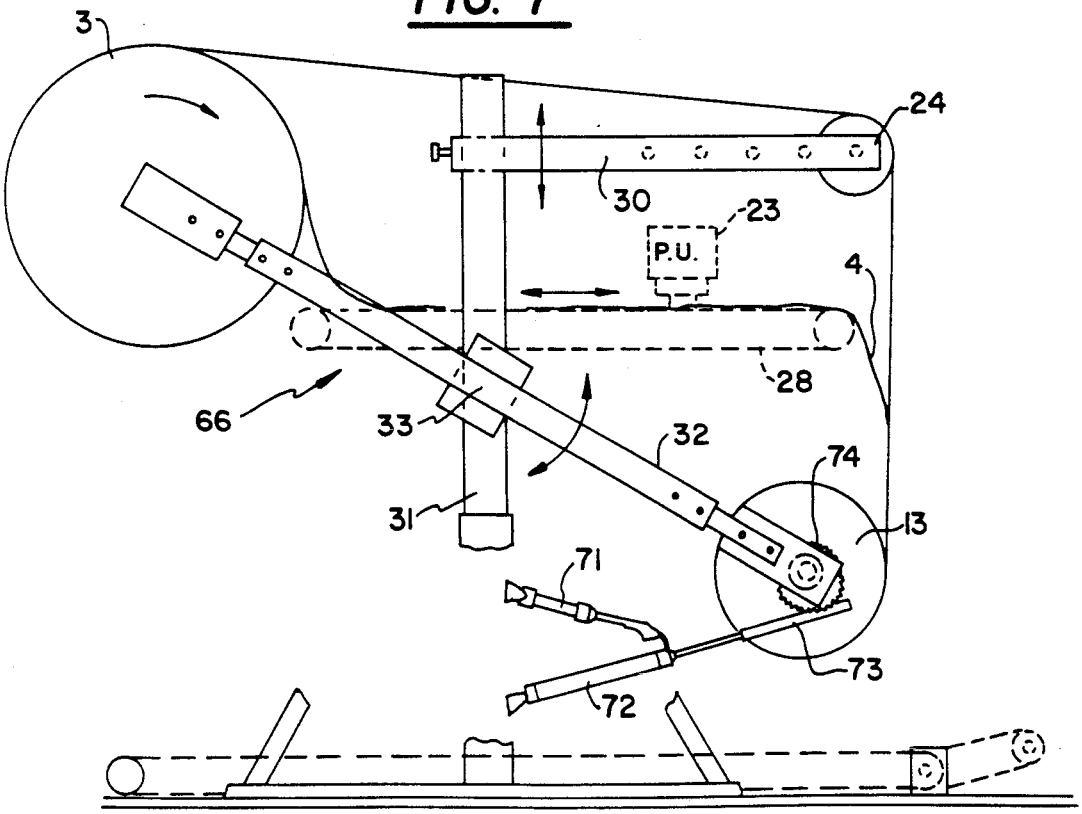

FIG. 7 relates to yet another possible embodiment, similar to the one of FIG. 6 as to operation, but supported in one supporting frame.

Figure 8:
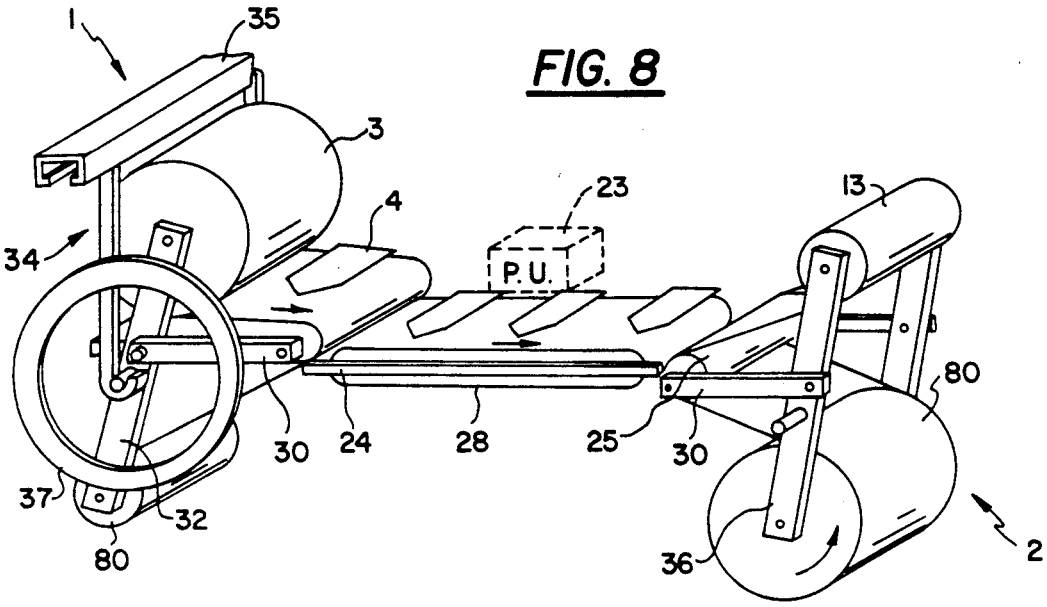

FIG. 8 represents an embodiment in perspective, wherein an unstacking device and a restacking device, respectively, are placed at the inlet and outlet side, respectively, of a processing unit.

Figure 9:
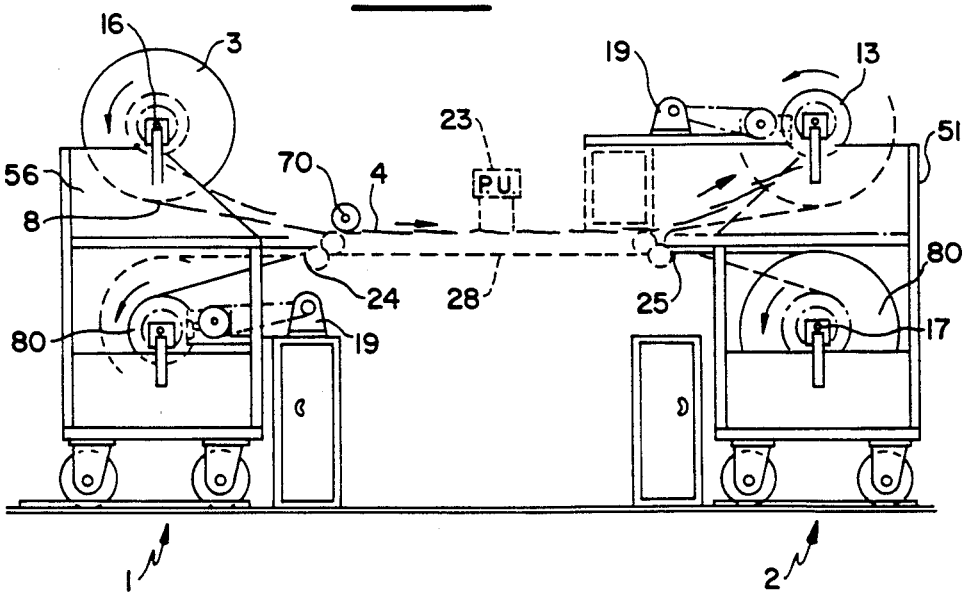

FIG. 9 is a schematic representation of the starting and finishing positions of the handling cycle with an apparatus analogous to the one in FIG. 8 and starting at the inlet side with a full stack to end there with an empty stack.

Figure 10:
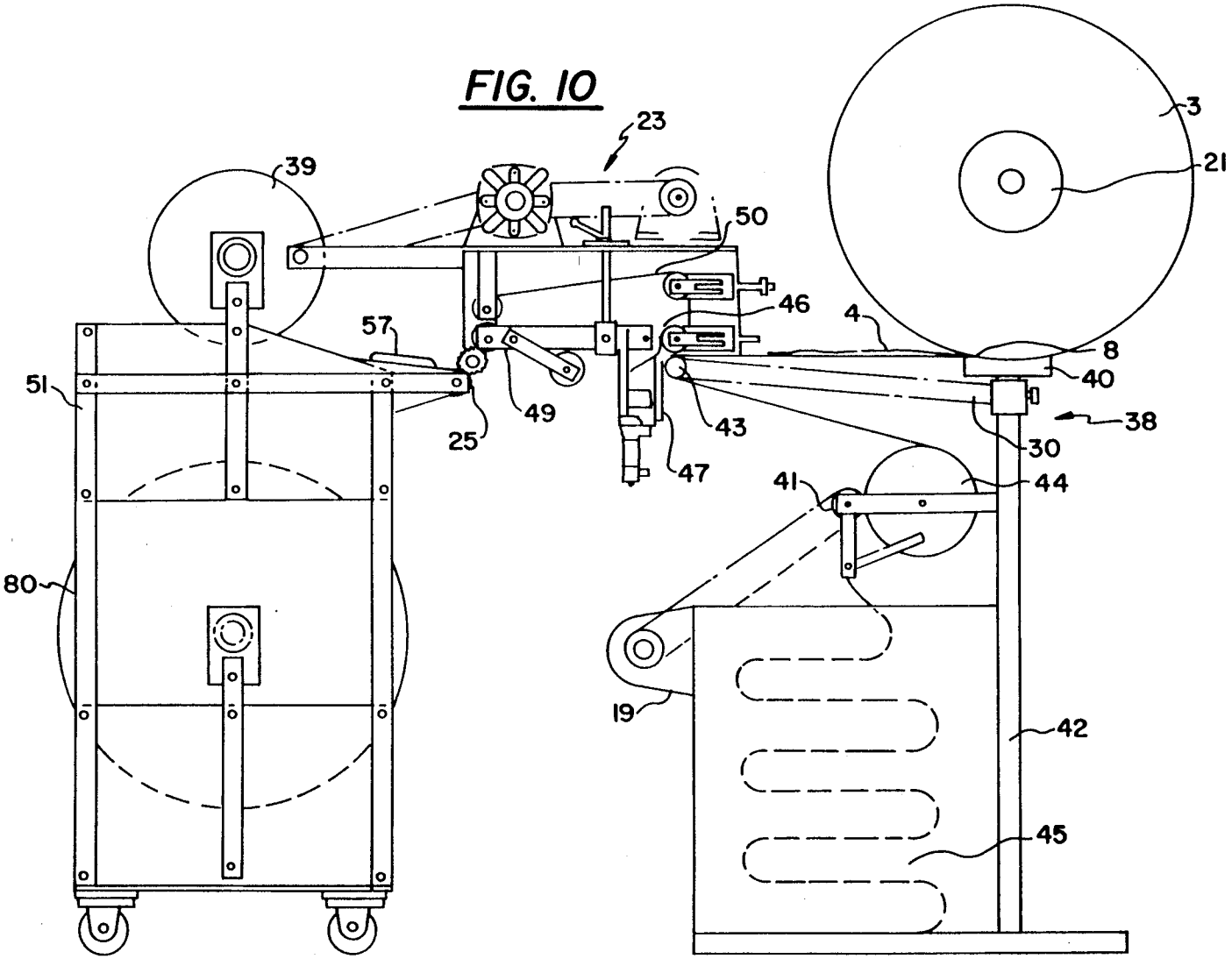

FIG. 10 is a schematic illustration of a folding operation for sheets with a variant embodiment of an unstacking device at the inlet side of the folding machine.

Figure 11:
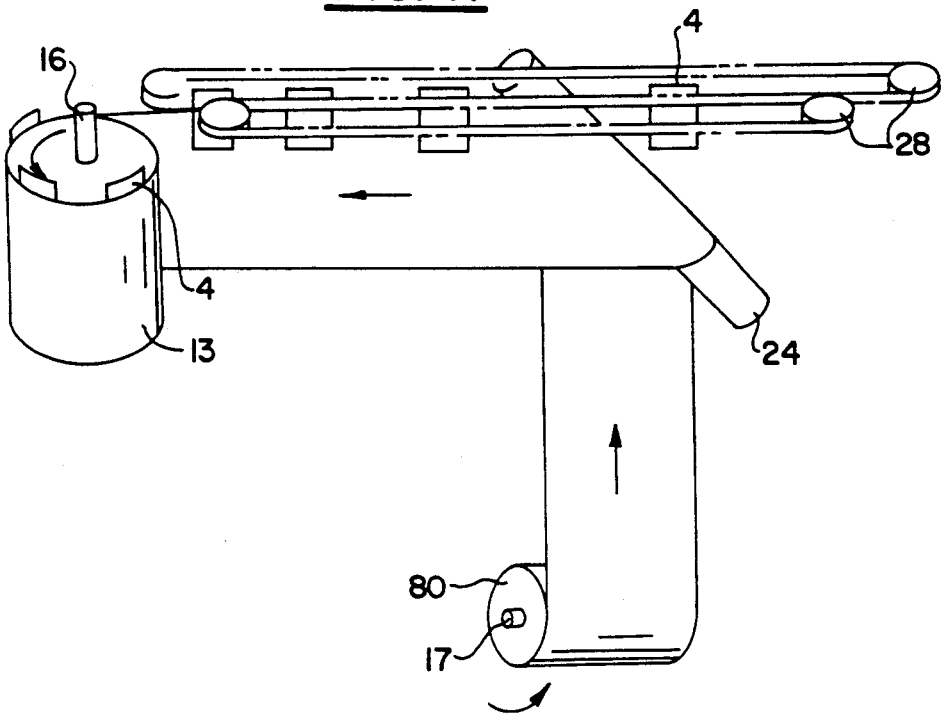

FIG. 11 is a sketched front view of a stacking device with upright winding axle and horizontally extending unwinding axle.

Figure 12:
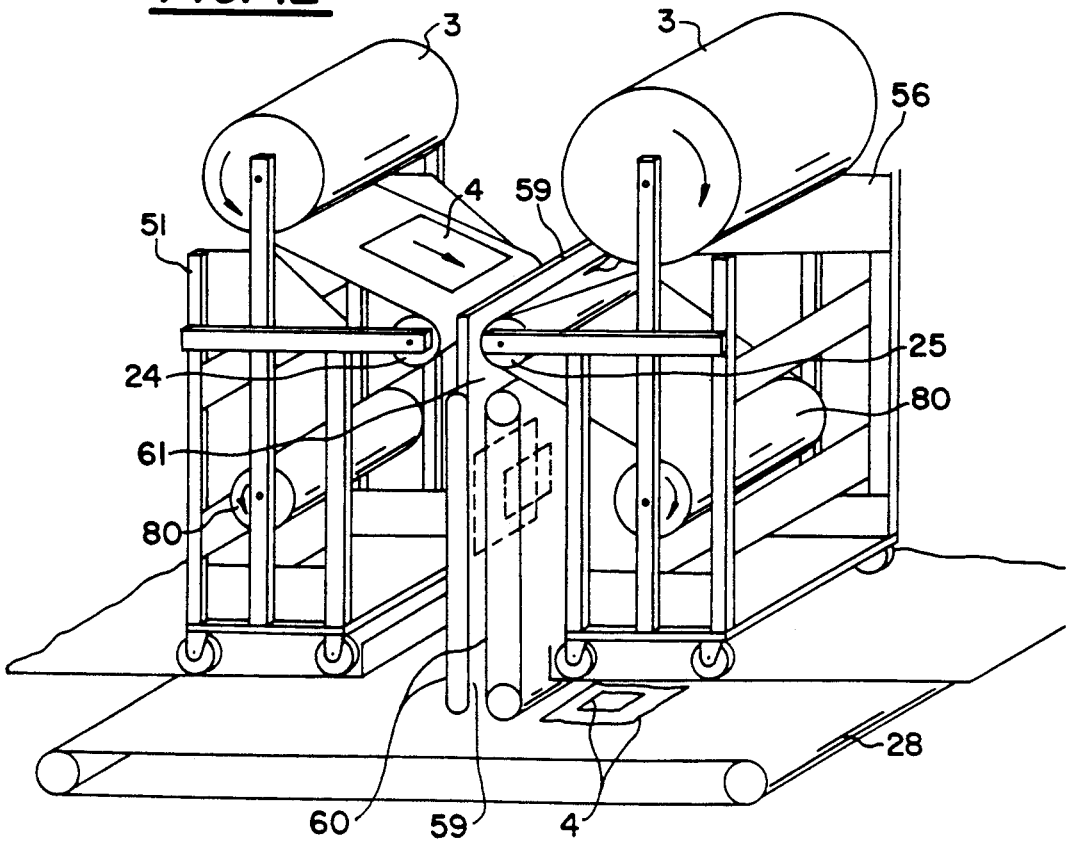
Figure 13:
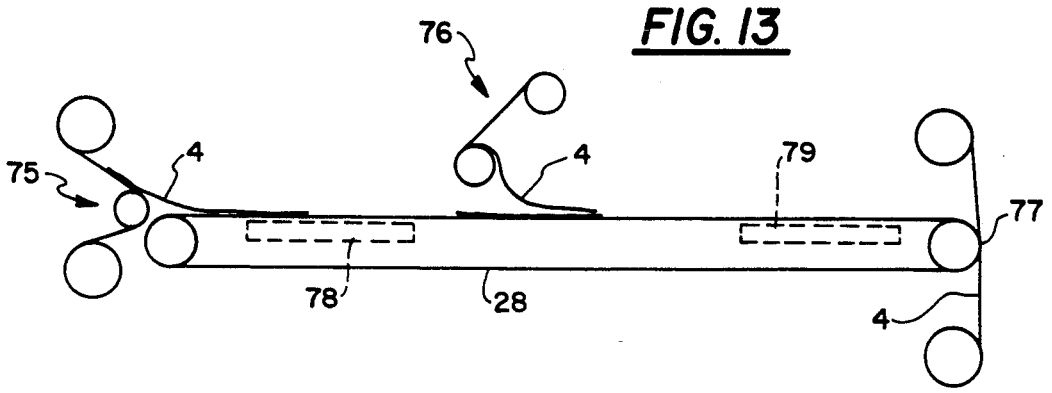

FIGS. 12 and 13 relate to embodiments wherein sheets are joined.

Figure 14:
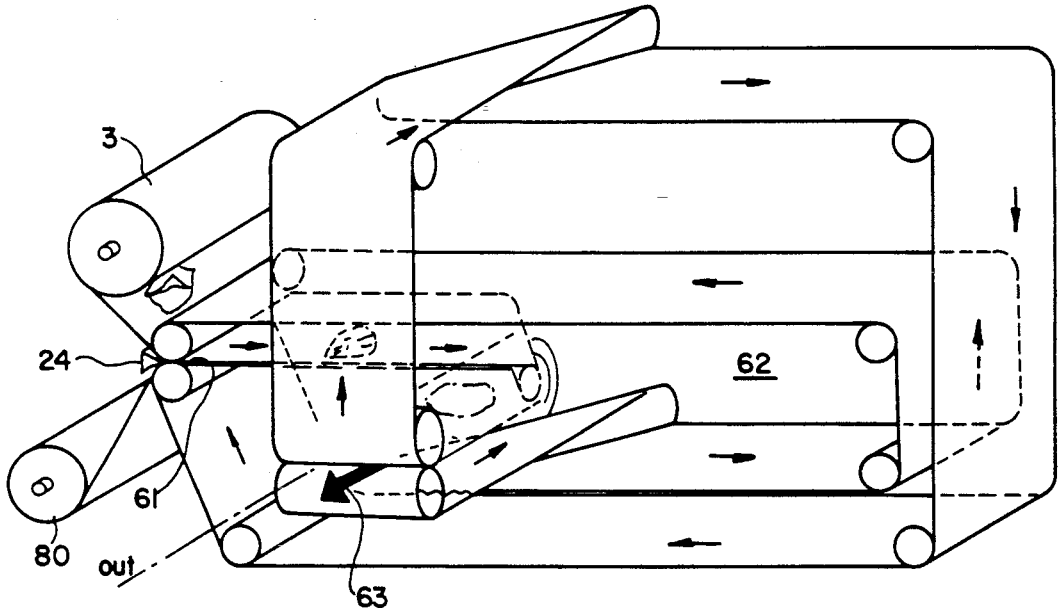

FIG. 14 illustrates a belt roll device to which a turnover apparatus for the sheets is linked.

FIG. 15 relates to the arrangement of embodiments similar to those of FIGS. 8 and 9 but with another relative position of the belt roll devices and for processing relatively long sheets.

FIGS. 16 to 18 represent arrangements where the two belt rolls rotate in opposite direction.

FIG. 19 relates to an arrangement similar to that of FIG. 15 but for processing relatively short sheets.

Figure 20:
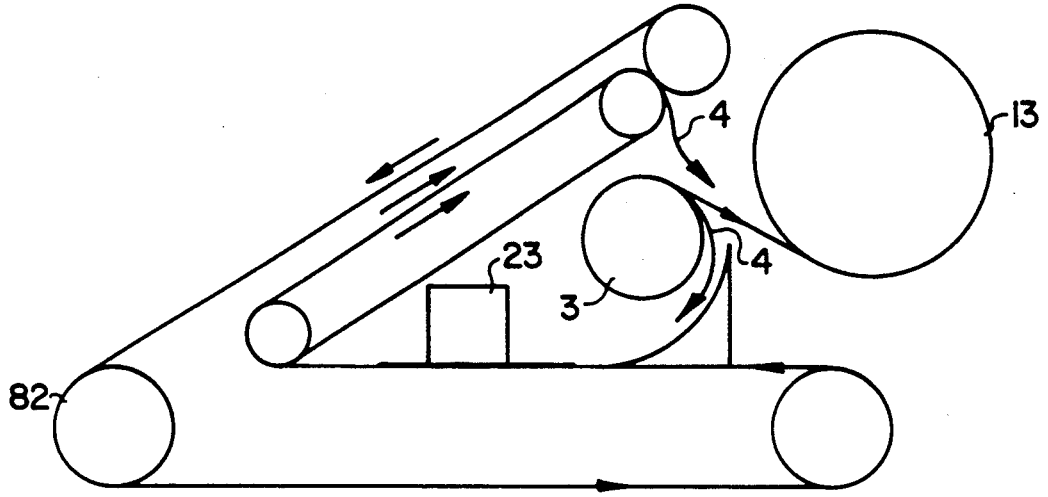

FIG. 20 shows an embodiment where release of non processed sheets and collection of processed sheets occur in the same belt roll device.

Figure 21:
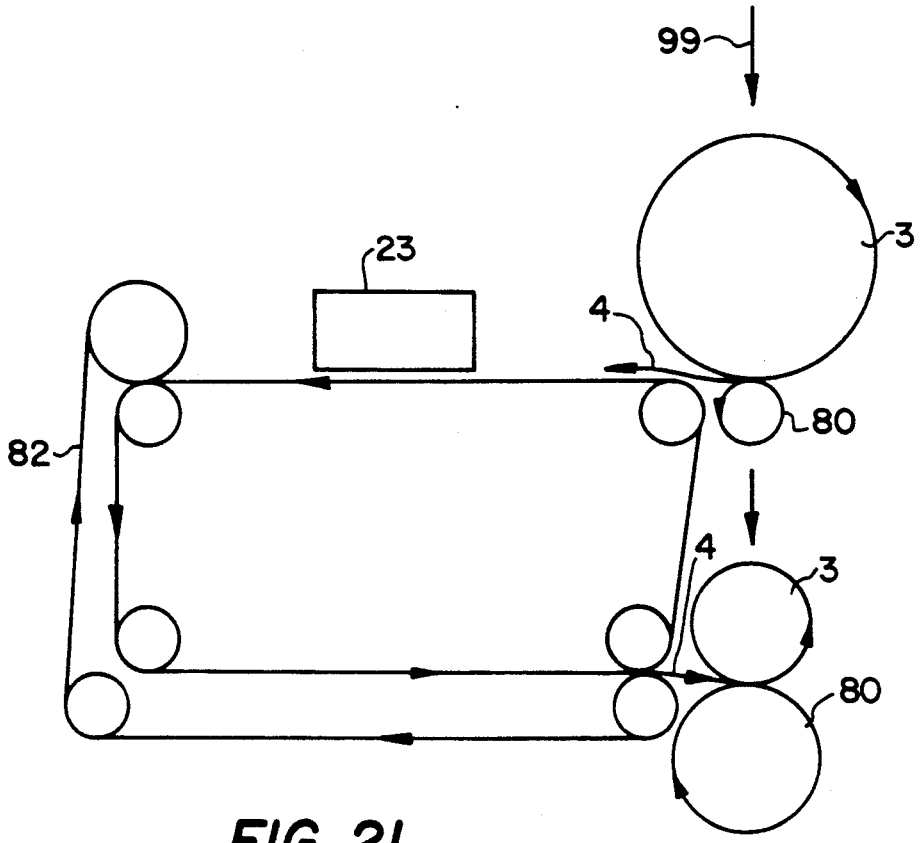

FIG. 21 relates to the situation where the two belt roll devices for delivery resp. for take up of sheets are situated right above each other.

Figure 22:
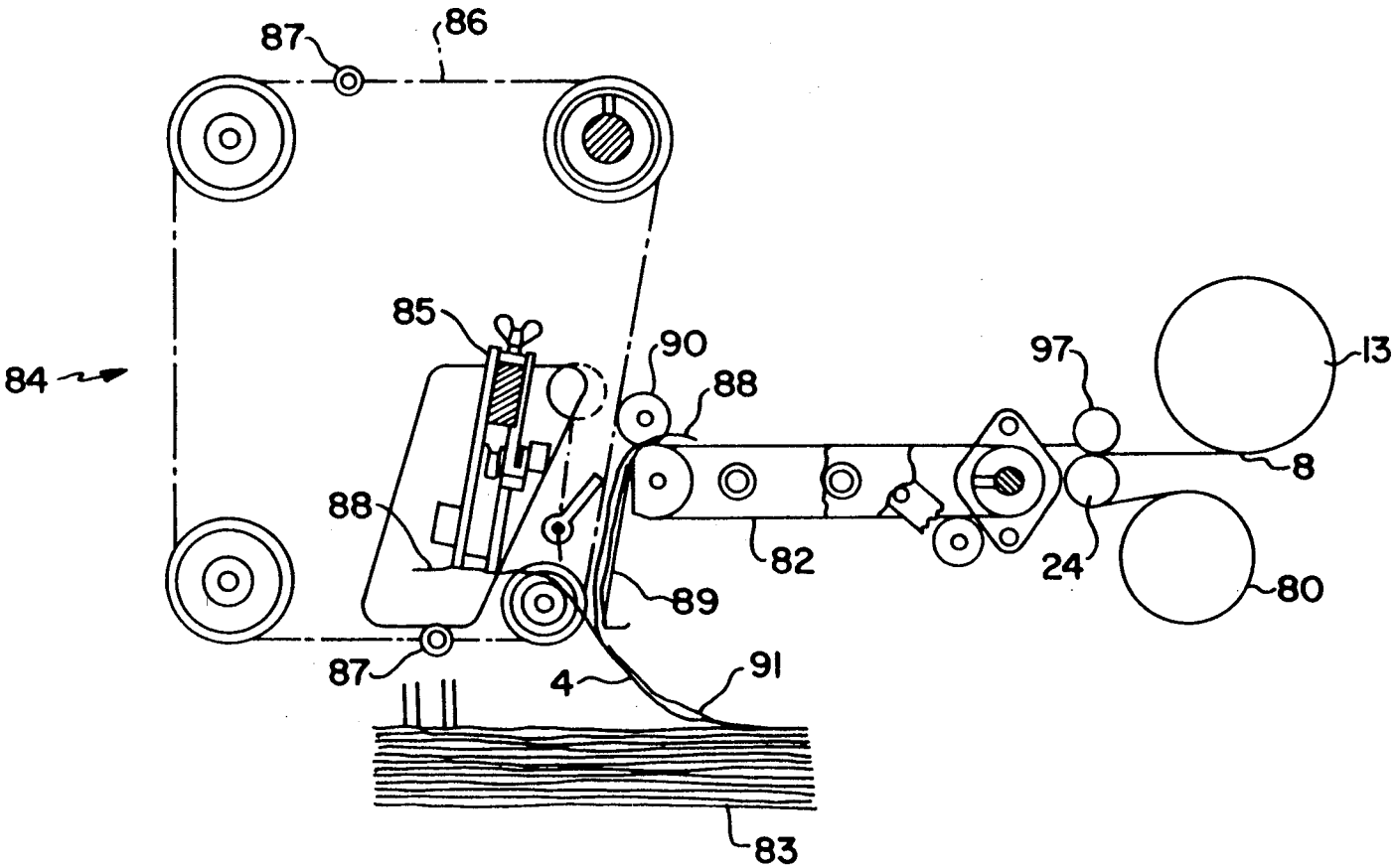

FIG. 22 shows equipment for separating sheets from a stack and transferring them to a belt roll.

The processing apparatus in accordance with FIGS. 1 and 2 comprises two supporting frames 1 and 2 wherein suitable supporting means 5 for the belt roll 3 and 6 for the wound belt stock 80, are mounted. After processing in the unit 23 the consecutive sheets 4 are introduced beyond the clamping line 8 and caught inside between the consecutive windings of the belt 3, and taken up in the roll. The sheets can be deposited one by one on the belt via e.g. means of conveyance 9.

The supporting frames 1 and 2, respectively, basically comprise a chassis 10 carrying a threaded rod 14 and 7, respectively. The chassis can be equipped to be mobile by means of wheels 11. Adjusting screws 12 for level adjustment can also be provided as well as a handle 15 e.g. for moving the supporting frames.

The supporting means 5 and 6 can be moved up and down via nut blocks 20 on the threaded rods 7 and 14. The winding axles 16 and 17 are carried on bearings in these blocks 20. The supporting means 5, 6 can also carry the drive motors 19 for winding and unwinding. The working height for belt roll 3 and belt stock 80 can be set by appropriately moving the nuts 20 up or down by turning the rods 7, 14 by means of the cranks 18. Also, means can be provided to appropriately shove composite belt rolls (with or without fixed mandril) elsewhere (outside the apparatus: on and off over the winding axles 16, 17. This enhances the flexibility of the apparatus to a great extent.

The use of two separate supporting frames 1 and 2 at an adjustable distance from each other and with adjustable heights for belt roll 3 and belt stock 80 makes it possible to effect any three-dimensional combination, wherein, basically, any possible length and slope can be given to the straight route of the belt between the two supporting frames. To that end, it is e.g. possible to provide an elevated platform 52 for the supporting frame 2 to move over. For certain applications, the supporting frames 1 and 2 can thus slide one into another as it were so that belt roll 3 and belt stock 80 end up nearly vertically one above the other. Should there already be sheets enclosed in the roll 80, these can, if desired, be added on the belt to those supplied by the conveyor 9 to store them together in belt roll 3.

Figure 3:
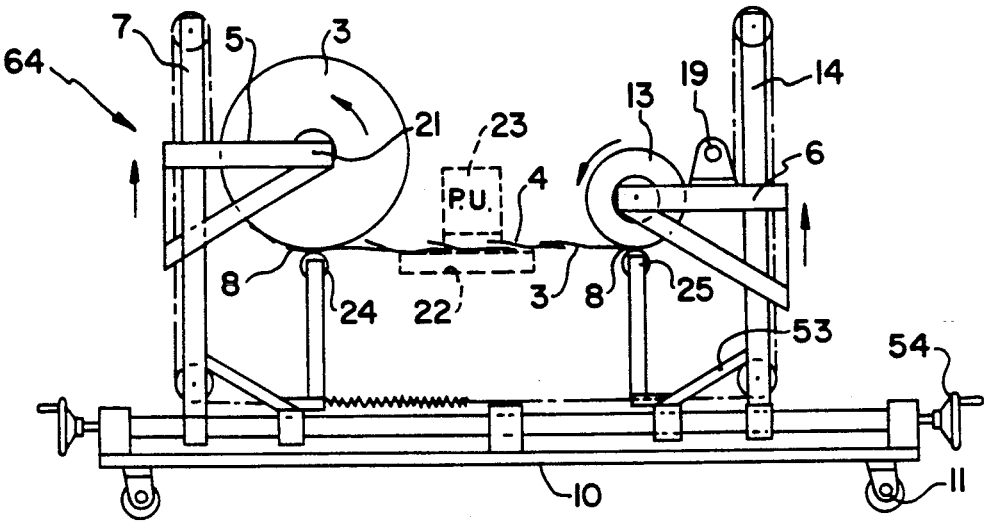
FIG. 3 is a schematic elevation of a handling apparatus in accordance with the invention wherein unstacking from the belt roll, processing of the sheets and immediate restorage of the processed sheets in a second belt roll take place within the space of one and the same framework.

In the processing apparatus in accordance with FIG. 3, belt roll 3 and second storage element 13 (also a roll), respectively, are both adjustably mounted in the same supporting frame 64. This is effected by means of the respective carrier frames 5 and 6 as supporting means that are slidably mounted on the respective stands 7 and 14. These carrier frames support the mandrils 21 of the belt rolls 3 and 13 at both their axle ends; in other words, the rolls each rotate between the two side arms of the frames 5 and 6, respectively. If so desired, the stands 7, 14 with their base supports 53 can also be mounted in the base frame or chassis 10 in a horizontally adjustable way by means of the rotatable threaded rods 54. This chassis can be equipped to be mobile by means of wheels 11.

The belt 3 with sheets 4 runs over a processing table 22 to the second storage element 13 in the form of a winding element. Some processing unit 23 is mounted above the processing table. In the processing route between belt roll 3 and roll 13, the belt is successively conducted between rollers 24 and 25 as guide means. With this construction, the clamping lines 8 remain stationary both when the sheets are rolled out at guide roller 24 and rolled in at guide roller 25. The drive of the apparatus can be effected by means of a motor 19 that engages via a suitable transmission with for instance the mandril end of roll 13 with the processed sheets 4. (In a number of cases, the drive of roll 13 will obviously have to be connected to the one of unit 23.) As the outside diameter and, hence, also the angular speed of the roll 3 varies during operation, the latter will be equipped with for instance a suitable slip coupling on its axle (and winding mandril 21) so that the belt 3 with the sheets 4 runs tautly through the processing route under the unit 23 and also unrolls tautly from roll 3 and rolls up tautly on roll 13. The speed regulation may be effected by means of a pulse generator mounted on roller 24.

Figure 4:
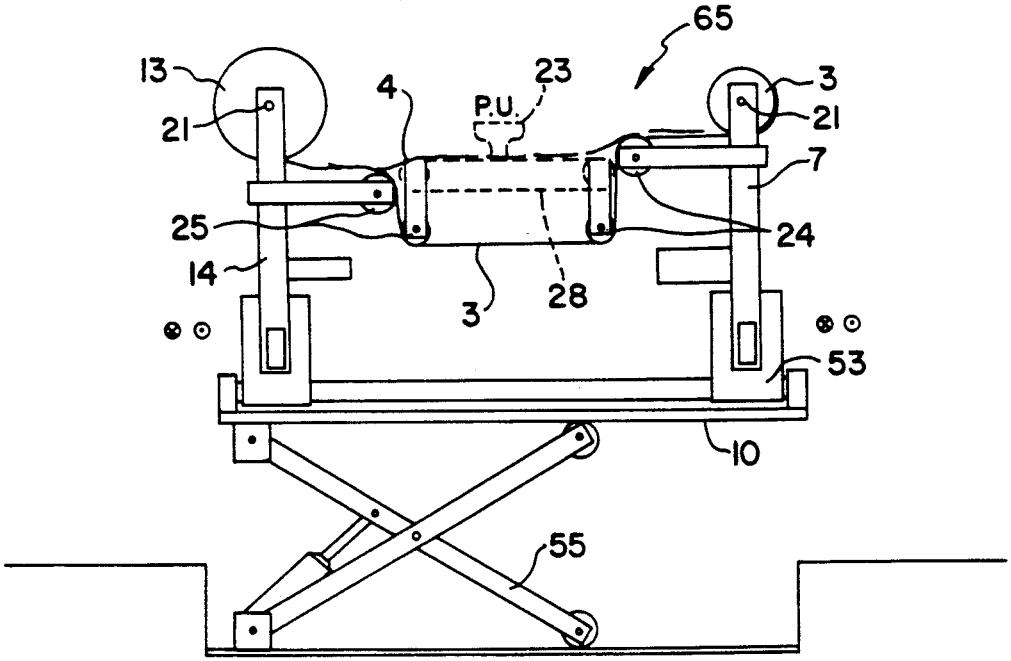
FIG. 4 shows an embodiment of the apparatus analogous to the one of FIG. 3 but with a different suspension of the belt roll axles.

In the variant embodiment in accordance with FIG. 4, the chassis 10 with the handling apparatus 65 is carried by an elevator 55. The stands 7 and 14 carry the axles 21 on which the rolls 3 and 13 are fitted (axially). The belt 3 runs through the route over the guide rollers 24 and 25. In the process, the sheets 4 are transferred onto the conveyor 28 of the processing unit 23. After processing, this conveyor delivers the sheets to the belt 3 again for restacking in roll 13 as second storage element. When belt 3 has been unrolled, the elevator 55 can lower the apparatus 65 until the belt 3 lies straight between roll 3 and 13. The processed sheets can then be fed back in their original order into roll 3. As a result, the apparatus is ready again to feed a following processing unit.

The sheets can extend transversely over a part of or whole the width of the belt 3. They can also extend beyond one or both longitudinal edges of the belt. If so desired, the protruding part can then be supported at the processing spot by a short feed conveyor connected to the processing unit.

Figure 5:
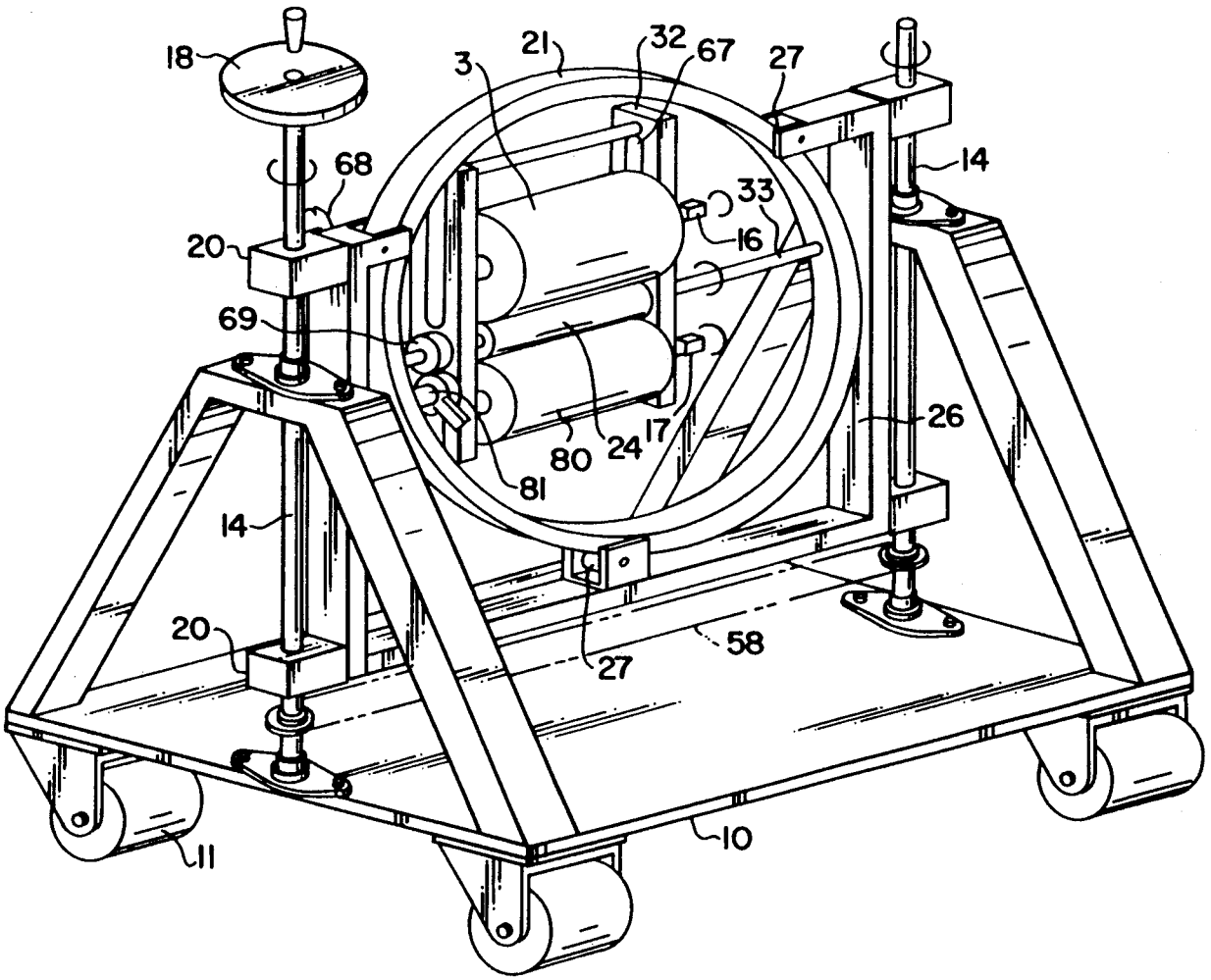
FIG. 5 is a perspective view of a universal apparatus which enables a rotation for the belt rolls around three perpendicular axes.

The apparatus according to FIG. 5 comprises a chassis 10 which is equipped to be mobile by means of wheels 11. The apparatus can thus be translated but also rotated around a vertical axis. Two threaded rods 14 are mounted on the chassis. They carry nut blocks 20 which are fixed to a frame 26. Said frame 26 can be moved up and down along the rods 14 by means of crank 18. A chain 58 transmits the rotative movement by crank 18 from one rod 14 to the other. The frame 26 supports the vertical ring 21 in which the frame 32 is mounted which carries the belt rolls 3, 80 and optionally one or more guiding rollers 24. Instead of a stock roll 80 for the empty belt, a second storage belt roll 13 for belt with sheets can be present. The belt rolls can be slid up and down in the frame 32 under the control of a certain counterpressure exerted by springs 67. Further the belt rolls can rotate around the horizontal shaft 33 which bears the frame 32. This rotation permits to fix the desired angular position or slope of frame 32. In most cases, rotation over 180° will be used to exchange the upper or lower position of either one of rolls 3 or 80. The setting of the angular position of frame 32 can be executed in a conventional way by intermeshing gears 69, 81. Gear 69 is fixed to frame 32 and the spring loaded gear 81 is fixed to the inner side of ring 21. Said ring 21 is rotatably supported against rollers 27 in frame 26. This arrangement thus permits a rotation of the belt rolls (in practice mostly over 180° ) around a horizontal axis perpendicular to the belt roll shafts 16, 17. Rotation can be performed by an actuator 68.

The variants of the apparatus and equipment in FIGS. 6 and 7 schematically show embodiments that operate in the same way. The supporting frames for the two embodiments differ, however. In FIG. 6, separate supporting frames 1 and 2 have been provided for belt roll 3 loaded with sheets 4, and for the restacking roll 13. In addition, there is a separate supporting frame 29 with carrier arm 30 for the guide roller 24 for the belt. However, the sheets 4 now come loose from the roll 3 in a suspended position. After processing on conveyor 28, they are collected again beyond the clamping line 8 of restacking device 13. At the same time, the belt is diverted over roller 24, which therefore determines the route for the belt together with the rolls 3 and 13. The three elements 3, 13 and 24, which determine the route for the belt, are incorporated in one supporting frame 66 according to the embodiment in FIG. 7. However, in addition to the up-and-down slidable carrier arm 30 for the (horizontally movable) guide roller 24, a (possibly extending) swivelling arm 32 is now mounted on the supporting column 31 in such a way that it can rotate on pivot 33. The pivot 33 can also be placed on different levels on the supporting column 31.

The belt roll 13 can also be driven intermittently. This can be effected by means of a piston rod combination 71, 72. The rack 73 which can slide in and out by means of cylinder 72, intermittently meshes with gear 74. Each time this rack, while it is in contact with this gear, has covered a stroke length determined via controls, from an extended position to a retracted position, the roll 13 rotates over the desired distance in winding direction. The cylinder 71 then pushes the rack off the gear 74. Contiguously, cylinder 72 pushes the rack out again; cylinder 71 pulls the rack back in meshing position with gear 74 and the cycle can start again.

The processing apparatus in accordance with FIG. 8 relates to a variant embodiment. Instead of mounting the apparatus as hereinbefore on a chassis that can be wheeled over the ground, it is also possible to slidably suspend it via a frame 34 in a rail 35, which then, if so desired, goes through an adapted circuit past a series of successive processing stations for the sheets. An essential difference with the embodiments hereinabove relates to the fact that the processing unit is placed between two belt roll devices 1, 2. In the apparatus near the inlet side of the processing unit (on the left in FIG. 8), the winding element 13 now no longer has the function of restacking device for processed sheets as e.g. in FIG. 1, 3 or 6. Only the empty belt is wound.

The winding device 2 at the outlet side of the unit 23 (on the right in FIG. 8) forms as it were the mirror image of the one at the inlet side. Here, the empty belt is unrolled from the winding element 80 and the finished sheets 4 are inserted one by one as the belt is rolled up to form roll 13. Both winding devices 1 and 2 are carried by a simple connecting frame (swivelling arm) 32 and 36, respectively. Preferably, these frames can be fixed in any possible angular orientation with respect to their suspension frame. An adjusting mechanism 37 has been provided to this end. The guide means 24 and 25, respectively, which help determine the paths for the belts in devices 1 and 2, can be coupled via suitable transmissions to the drive apparatus for processing unit 23 and conveyor 28. The relative position of the guide rollers 24 and 25 with respect to the winding devices 13 and 2 is adjustable as well, for instance via carrier arms 30.

The unstacking device can also be smoothly moved in transverse direction (with respect to the sheet conveying apparatus) during operation by moving the frame 34 back and forth in the rail 35. This way, the depositing position of the sheets 4 on the conveyor 28 can be adjusted as desired.

FIG. 9 illustrates starting and finishing positions in an operation cycle with the processing system analogous to the one in accordance with FIG. 8. The starting position of the stacking devices 3, 13, 80 is represented in continuous line. The finishing position corresponds with the dotted line. As soon as a feeding apparatus, i.e. an unstacking device on framework 56 has been emptied, it can be removed from the inlet side of the processing unit 23. After the full restacking device on framework 51 has been removed as well from the outlet side of the unit 23, an empty stacking device can come in its place on framework 56. Obviously, the drives via motors 19 are coupled to the one of the processing unit 23. In the framework 56, there will be a suitable slip coupling on the axle 16 of the belt roll 3. This will also be the case on axle 17 of roll 80 in framework 51. If the order of processing in a following processing cycle has to be the same as in a previous one, the full roll 13 in the restacking device 51 at the exit of the first processing unit 23 will have to be rewound to another roll first. This can for instance be effected in a framework 64 in accordance with FIG. 3 with horizontal route for the belt between the belt rolls.

Let us assume for a moment that sheets that partly overlap in the direction of conveyance, have been taken up in the roll 3 on framework 56 (compare sheets 4 in FIG. 3). In this case, the belt roll 3 can unroll intermittently. The belt roll is stopped each time an upper unit of a series of overlapping sheets has been unrolled completely past the clamping line 8 whereas the lower sheet is still clamped with a part in the roll upstream of the clamping line. The released upper sheet is then dragged off from the lower clamped sheet on the stationary belt 3 by means of the conveyor 28 (and maybe a counterpressure roller 70) and conveyed to the processing unit 23. When the upper sheet has been completely dragged off from the lower one, the belt roll 3 resumes its unrolling operation for the lower sheet that is now in its turn lying on top and the cycle repeats itself.

Further, FIG. 10 schematically shows another handling apparatus variant at the inlet side of a unit 23. Here, the processing unit 23 is a folding machine for the sheets 4 supplied from an unstacking device 38 which basically comprises a belt roll 3 on a mandril 31. The roll is supported by a pair of rollers 40 mounted on a stand 42. In this embodiment as well, the clamping line (8) remains stationary as the sheets are conducted out. The roll 3 delivers the belt with sheets 4 at the inlet side of the folding machine 23. Rollers 40, 43 and 44 determine the route or path followed by the belt before it is deposited in a container 45 for instance. The pulling roller 44 is driven via a counterpressure roller 41 connected to a motor 19. Each time a sheet 4 passes the upright folding slot 46, an up and down movable folding knife 47 presses it vertically folded into a the feeding nip of the folding slot 46 between conveyor belts 49 and 50. The folded sheets 57 are then horizontally advanced between conveyors 49 and 50 to the receiving beltroll 39 of the restacking device 51 analogous to the one of FIG. 9.

Sheets 4 that are supplied vertically by means of a conveyor 28 can also be stacked in a belt roll 13 if its axle 16 is vertically oriented as shown in FIG. 11. If so desired, the belt stock 80 can then unwind on a horizontal axle 17. The guide roller 24 then slopes so as to deflect the belt route from some direction or other for instance from vertical or upwards to horizontal.

According to FIG. 12, sheets 4 can also be joined with winding apparatus 51, 56 (analogous to the one in FIG. 9). The sheets are supplied at adapted speed at both sides of the guide plate 59 near the feeding area 61 with the feed-through belts 60. At the end of the feed-through route, they are taken over in joined position by the conveyor 28.

FIG. 13 shows another apparatus wherein sheets 4 are supplied to a conveyor 28 by unstacking devices 75 and 76. The unrolling operation by these apparatus is controlled so that a sheet 4 from the unstacking device 76 is exactly deposited on a sheet 4 from unstacking device 75. A positioning apparatus 73 (for instance as described in U.S. Pat. No. 4,572,499) can be provided for the first sheet 4 before the second sheet 4 from unstacking device 76 is deposited on this first one. It is also possible to place here a processing unit other than a positioning apparatus. If so desired, another further processing unit 79 can be installed for the joined sheets before restacking. Both sheets 4 may be rolled into the restacking device 77 in a reverse stacking order (compared to that on conveyor 28). FIG. 14 shows as processing unit a sheet reversing or turn-over apparatus 62 fed at its inlet by an apparatus (unstacking device) in accordance with the invention. Either a second processing unit or a restacking device for the turned sheets can then be placed at the outlet side of this apparatus 62 (at arrow 63).

In view of using as little floor space as possible in the shop, either the sheet delivering or the sheet collecting apparatus can be arranged above or underneath the processing table where the unit 23 is posed. An example of such an arrangement is illustrated in FIG. 15. Overlapping sheets 4 within a relatively great length are released by belt roll 3 from apparatus 1. Before feeding them to the processing station 23, they are reversed. This can be achieved by blowing the trailing sheet edge by means of a blower 94 onto the upper surface of suction box 93 which keeps this edge fixed on said surface during transfer of the box 93 to the inlet end of the processing unit 23.

After processing they are advanced between pivotably mounted conveyors 82 to the inlet side of the collecting belt roll 13 and reversed before passing to clamping line 8. The processed sheets are thus collected in the same orientation as they left the roll 3. In this equipment the belt device 13, 80 with the newly stored sheets 4 is thus rendered completely interchangeable with the belt device 3, 80 for feeding a further processing unit. If desirable the feeding belt roll device 3, 24, 80 can also be lifted (arrow 98) so that the leading edge 100 of sheet is positioned at the level of the surface of the suction box 93 before starting transfer to the unit 23.

It is also possible to arrange the belt rolls and the route for the belt between the release an collecting lines 8 so that the rolls 3 and 13, resp. 3 and 80 turn in opposite direction. In essence the embodiments can operate as shown in FIGS. 16 to 18 which are in fact self explanatory.

The belt roll pairs 3, 80 and 13, 80 can contact each other without free belt section: see FIG. 16. Otherwise a free belt section can be provided between two consecutive clamping lines 8 as shown in FIGS. 17 and 18.

The equipment of FIG. 19 is similar to that of FIG. 15. However it is particularly suitable for processing overlapping sheets which are relatively short in the travel direction. After processing they are taken up by a conveyor 96 with grippers 101 which deposit the sheets in an arrangement with the desired overlap on the conveyor 82. The take up is controlled by e.g. a photoelectric device 95.

Another embodiment where the belt rolls 3, 13 run in opposite direction is shown in FIG. 20. The sheets are released from belt roll 3 and conveyed to the inlet side of processing unit 23. After processing they are advanced by means of a set of conveyors 82 to the collecting station 13 for the processed sheets.

In a similar arrangement, as shown in FIG. 21, the equipment comprises two belt roll devices 3, 80 placed one right above the other. By means of a vertical translation (arrow 99) the two devices can be interchanged. However leading and trailing edge of each sheet have been reversed with respect to their position in the feeding belt roll. In a number of cases this in not inconvenient.

It is also possible to replace the two belt roll devices of FIG. 21 by one apparatus as shown in FIG. 5. The sheets to be processed are then released from the nip (upper clamping line) between the underside of belt roll 3 and the upper side of roller 24 whereas the processed sheet is collected upon entering the nip (lower clamping line) between the underside of roller 24 and the upper side of belt roll 80 (13).

Finally, a feeding apparatus 84 will be described for transferring sheets 4 from a stack 83 to a belt roll 13. This apparatus is an important link between the cutting shop and the processing of the sheets in the clothing workshop. The apparatus 84 comprises a set of pick up heads 85 similar to those described in applicant's U.S. Pat. Nos. 3,981,495 or 4,348,018. A pair of circulating chains 86, are mounted in the frame of the apparatus. They carry at least one oblong roller 87 movable by said chains over the stack and along the inlet side of a conveyor 82. The sheet 4 is first picked up and lifted near its edge 88 from the stack. Before releasing the sheet from the pick up head, its edge 88 is taken over by the roller 87 which carries it along with the circulating chains 86 against plate 89 for further guiding to the conveyor 82. The sheet leading edge 88 is released from the pick up head 85. A pivotable cantilever roller 90 is properly arranged to press the leading sheet edge 88 against the conveyor 82. The rate of sheet removal is e.g. about one per second. From this spot onwards the sheet 4 is further advanced with its leading edge 88 to the nip between roller 97 and the belt running over guiding means 24 whereas the trailing edge 91 of the sheet is further separated from the stack. In the case of relatively long sheets to be separated, a second leading sheet edge 88 is already lifted before the trailing edge 91 of the previous upper sheet is fully separated from said second sheet. It is an important advantage of this equipment that sheets can be separated one by one from the stack 83 without having to displace or remove it from its initial support where it was cut or otherwise formed.

It is obvious that still further variants are conceivable in the embodiment of the processing apparatus or its component parts. For instance, the belt can be divided into a number of adjacent strips.

We claim:

1. A method of manipulating a series of individual sheets from a stacked supply with an apparatus, the method comprising the steps of:

successively collecting individual sheets from the stacked supply by gripping each individual sheet, suspending the gripped sheet and lifting the sheet at a point that will remove the individual sheet from the stacked supply without displacing the next sheet of the stacked supply, and feeding each successively collected sheet onto a conveyor system of the apparatus; and conveying the individual sheets in a sequential fashion and collecting the conveyed sheets into successive windings of a belt roll.

2. The method according to claim 1, wherein the step of conveying the successive sheets includes overlapping the successive sheets.

3. The method according to claim 1 or 2, wherein the conveyance step includes positioning, reorienting and reversing the successive sheets at least one during the conveyance thereof.

4. The method according to claim 1, wherein the step of successively collecting individual sheets from the stacked supply includes gripping each individual sheet near a leading edge thereof.

5. An apparatus for processing textile sheets comprising:

a support frame;

a belt roll device including:

first and second belt rolls, each said belt roll having a shaft, said first and second belt rolls being rotatively supported on the support frame by said shafts, a belt being carried by said belt rolls; and guide means for guiding a portion of the belt between said first and second belt rolls, said belt roll device defining a clamping line;

means for picking up the textile sheets one after another near a leading edge thereof; and means for guiding and advancing the sheets with the leading edge thereof directed toward the clamping line of the belt roll device.

6. The apparatus as claimed in claim 5, further comprising means for driving said belt rolls.

7. The apparatus as claimed in claim 5, wherein said first and second belt rolls are disposed at a common side of a belt section of the belt roll device, said belt section connecting the belt rolls.

8. The apparatus as claimed in claim 7, wherein said guide means is disposed at opposing sides of said belt section.

9. The apparatus as claimed in claim 7, wherein said guide means are disposed at said common side of the belt section.

10. The apparatus as claimed in claim 7, wherein said guide means is provided at a side of the belt section opposite said common side.

11. The apparatus as claimed in claim 5, wherein said first and second belt rolls are disposed at opposing sides of a belt section of the belt roll device, said belt section connecting the belt rolls.

12. The apparatus as claimed in claim 11, where said guide means is provided at one of said opposing sides of said belt section.

13. The apparatus as claimed in claim 11, wherein said guide means is disposed at opposing sides of said belt section.

14. An apparatus as claimed in claim 5, wherein said support frame is adjustable in height, pivotable about an axis parallel to the shafts of the belt rolls and is mounted on a movable chassis.

* * * * *